US010858960B2

(12) United States Patent
Zwinkels

(10) Patent No.: US 10,858,960 B2
(45) Date of Patent: Dec. 8, 2020

(54) POWER PLANT FOR GENERATING ELECTRICAL ENERGY AND METHOD FOR OPERATING A POWER PLANT

(71) Applicant: Lumenion GmbH, Berlin (DE)

(72) Inventor: Andrew Zwinkels, Berlin (DE)

(73) Assignee: Lumenion GmbH, Berlin (DE)

( * ) Notice: Subject to any disclaimer, the term of this patent is extended or adjusted under 35 U.S.C. 154(b) by 0 days.

(21) Appl. No.: 16/494,560

(22) PCT Filed: Mar. 11, 2018

(86) PCT No.: PCT/EP2018/055990
§ 371 (c)(1),
(2) Date: Sep. 16, 2019

(87) PCT Pub. No.: WO2018/172107
PCT Pub. Date: Sep. 27, 2018

(65) Prior Publication Data

US 2020/0011207 A1 Jan. 9, 2020

(30) Foreign Application Priority Data

Mar. 20, 2017 (EP) ..... 17161768

(51) Int. Cl.
*F01K 3/18* (2006.01)
*F24H 7/02* (2006.01)
(Continued)

(52) U.S. Cl.
CPC ..... *F01K 3/186* (2013.01); *F24H 7/0208* (2013.01); *F24H 7/0433* (2013.01);
(Continued)

(58) Field of Classification Search
CPC ..... F01K 3/186; F28D 2020/0047; F28D 2020/0078; F24H 7/0208; F24H 7/0433; F24H 2240/00
See application file for complete search history.

(56) References Cited

U.S. PATENT DOCUMENTS 6,701,711 B1 * 3/2004 Litwin ..... F02C 1/05 60/641.11
9,938,896 B2 * 4/2018 Bannari ..... F01D 15/02
(Continued)

FOREIGN PATENT DOCUMENTS

DE 102012103621 A1 10/2013
DE 102013016077 A1 4/2015
(Continued)

OTHER PUBLICATIONS

Swanekamp, R. "Windpower Surfaces as Near-Term Generation Option", Power, vol. 139, No. 1, Jan. 1, 1995, pp. 36, 38-40.
(Continued)

*Primary Examiner* — Shafiq Mian
(74) *Attorney, Agent, or Firm* — LaBatt, LLC

(57) ABSTRACT

A power plant for generating electrical energy comprises at least a heat storage device (100) for storing electrical energy in heat energy, comprising: an electrical heater (10) for converting electrical energy in heat energy; a heat storage body (30, 31) for receiving and storing heat energy of the electrical heater (10); a heat exchanger (50) for receiving heat energy from the heat storage body (30, 31). The power plant further comprises a turbine (120) and a generator (123). A heat storage fluid circuit (130) connects to the heat exchanger (50) or the heat exchangers (50) and a working fluid circuit (140) connects to the turbine (120). A fluid
(Continued)

circuit heat exchanger (131) transfers heat from the heat storage fluid to a working fluid in the working fluid circuit (140).

11 Claims, 2 Drawing Sheets

(51) Int. Cl.
*F24H 7/04* (2006.01)
*F28D 20/00* (2006.01)

(52) U.S. Cl.
CPC .. *F24H 2240/00* (2013.01); *F28D 2020/0047* (2013.01); *F28D 2020/0078* (2013.01)

(56) References Cited

U.S. PATENT DOCUMENTS

2007/0099261 A1* 5/2007 Keasling ..... C12N 9/88 435/52
2011/0083443 A1* 4/2011 Jockenhoevel ..... F01D 15/00 60/772
2011/0127773 A1* 6/2011 Freund ..... F01K 23/10 290/52
2011/0277469 A1* 11/2011 Brenmiller ..... F03G 6/067 60/641.8
2012/0255471 A1* 10/2012 Mishima ..... F23C 7/08 110/347
2016/0024917 A1* 1/2016 Hall ..... E21C 35/183 299/105
2016/0024973 A1* 1/2016 Rosenfeld ..... F01K 3/186 60/645

FOREIGN PATENT DOCUMENTS

EP 2101051 A1 9/2009
WO 2012000002 A2 1/2012

OTHER PUBLICATIONS

International Search Report and Written Opinion for Application No. PCT/EP2018/055990, dated Jul. 19, 2018, 11 pages.
English translation of International Search Report and Written Opinion for Application No. PCT/EP2018/055990, 10 pages.

* cited by examiner

POWER PLANT FOR GENERATING ELECTRICAL ENERGY AND METHOD FOR OPERATING A POWER PLANT

TECHNICAL FIELD

The disclosure relates to a power plant for generating electrical energy. Furthermore, the disclosure relates to a method for operating a power plant.

BACKGROUND

A power plant may be, for example, a system which burns an energy carrier to generate electrical energy based on the released heat energy. This comprises, for example, gas power plants and coal power plants which burn natural gas or coal, respectively, as the energy carrier. Furthermore, a reformer, for example, may generate a syngas or hydrogen gas which is burned.

The amount of generated electrical energy which is fed into an electrical grid by a multitude of producers varies significantly over time. In particular the increased use of regenerative energy sources leads to strong variations of the total amount of generated electrical energy over time. The available electrical energy may thus surpass a momentary demand significantly. For example in such cases it is desirable to store generated electrical energy. Energy storages that store the energy electrically or chemically (for example, electrochemical batteries or capacitors), however, can only store relatively small amounts of energy at reasonable costs. Pump storage plants are used to store larger amounts of energy. However, pump storage plants require a large height difference and can usually only be built in mountainous regions.

The applicant has developed proposals for solution in previous inventions (publication numbers EP 3002250 A1, EP 3139108 B1, EP 3139107 B1), wherein electrical energy is temporarily stored as heat energy and can be converted back into electrical energy in the power plant. A generic heat storage device is, for example, described by the applicant in the European patent application with the publication number EP 3002250 A1.

Such a generic power plant for generating electrical energy comprises at least a heat storage device for storing electrical energy as heat energy. Each heat storage device comprises at least one heat storage unit, wherein each heat storage unit comprises:

- an electrical heater for converting electrical energy into heat energy,
- at least one heat storage body for receiving and storing heat energy of the electrical heater,
- a heat exchanger for receiving heat energy from the heat storage body, wherein the heat exchanger comprises heat exchanger tubes for guiding a heat storage fluid.

The power plant comprises furthermore at least a first turbine and a generator coupled with the first turbine to generate electrical energy from a rotational movement provided by the turbine.

Electrical energy is thus taken from an external power grid and converted with the electrical heaters into heat energy. The electrical heater may, for example, comprise resistive elements which generate heat when an electrical current flows through the resistive elements. The heat energy is then stored in the heat storage body. The heat storage body may, for example, comprise a metal plate. A heat exchanger is adjacent the heat storage body and comprises at least tubes through which the heat storage fluid passes. The tubes of the heat exchanger may either directly engage the heat storage body or may be connected with the heat storage body through a heat transfer material (for example a metal body) which is part of the heat exchanger. The length and the cross-section of tubes of the heat exchanger may be chosen such that the heat storage fluid vaporizes or boils when flowing through the heat exchanger, i.e., for example liquid water transitions to water vapor.

In such a power plant, electrical energy is received from an external power grid and stored as heat energy with the heat storage device. Furthermore, the stored heat energy may be converted back into electrical energy and output to the external power grid. A control unit can set whether momentarily more electrical energy is taken from the power grid or output to the power grid. This allows to at least partially compensate variations of an amount of energy in the power grid.

Similarly, a generic method for operating a power plant to generate electrical energy comprises the following steps:

- converting electrical energy into heat energy with an electrical heater of a heat storage unit which may be a part of at least one heat storage device;
- receiving and storing heat energy of the electrical heater with at least one heat storage body of the heat storage unit;
- transferring heat energy from the heat storage body to a heat storage fluid with the help of a heat exchanger which comprises heat exchanger tubes for guiding a heat storage fluid;
- driving at least a first turbine; and
- generating electrical energy from a rotational movement provided by the turbine with the help of a generator coupled with the first turbine.

The heat storage bodies are operated between a minimal temperature and a maximal temperature. This temperature difference determines the amount of energy which the heat storage body is able to store in operation and release to the heat storage fluid. A variable temperature of the heat storage body, however, means that the temperature of the heat storage fluid after passing through a heat exchanger also depends on the momentary temperature of the respective heat storage bodies. The temperature of the heat storage fluid may thus vary significantly in operation.

Additionally, a turbine should be driven with vapor with a specific and preferably constant temperature. First, the efficiency of a turbine is dependent on the temperature of the flow of vapor, and second, undesired material strain may occur if the temperature of the flow of vapor changes quickly.

These problems are not satisfactorily overcome with known power plants.

It may be regarded an object of the invention to provide a power plant and a method for operating a power plant which can particularly efficiently store energy temporarily and then output the energy again in electrical form.

SUMMARY

The above object is reached with the power plant according to claim 1 as well as the method with the features of claim 9.

Preferred variants of the power plant of the invention and the method of the invention are subject-matter of the dependent claims and are addressed in the following description.

According to the invention, in the above-described power plant a heat storage fluid circuit connected to with the heat exchanger or the heat exchangers. A working fluid circuit is distinct from the heat storage fluid circuit and is connected with the first turbine (and in particular with optionally provided further turbines). At least a first fluid circuit heat exchanger is provided and connected with the heat storage fluid circuit as well as the working fluid circuit for transferring heat from the heat storage fluid to a working fluid in the working fluid circuit.

Similarly, the above-described method is, according to the invention, characterized by at least the following steps:

- transporting the heat storage fluid along a heat storage fluid circuit which comprises at least a first fluid circuit heat exchanger;
- with the help of the at least a first fluid circuit heat exchanger, transferring heat energy from the heat storage fluid to a working fluid;
- transporting the working fluid in a working fluid circuit to the first turbine for driving the first turbine.

The heat storage fluid is thus not guided through the turbine(s). Rather, only the working fluid is guided through the turbine(s). A temperature variation of the heat storage fluid thus has only a small impact on the temperature of the working fluid. Advantageously the turbine can thus be driven with vapor having a substantially constant temperature. Furthermore, a relatively high pressure of, for example, 100 bar is only required at the turbine(s). The two separate circuits allow the pressure of the fluid to the heat storage units to be smaller than the fluid pressure to the turbines.

For example, a working fluid pump can be operated to pressurize the working fluid in the working fluid circuit, and a heat storage fluid pump can be operated to pressurize the working fluid in the heat storage fluid circuit. The working fluid pump and the heat storage fluid pump are operated such that the pressure of the working fluid is larger than the pressure of the heat storage fluid. Alternatively or in addition, the power of the working fluid pump can be larger than the power of the heat storage fluid pump. The higher pressure may, for example, be defined by a pressure comparison of the pressures behind the respective pumps.

The working fluid circuit and the heat storage fluid circuit may each comprise a pipe system, wherein these two pipe systems are separated from each other. The fluid circuit heat exchanger may be a heat exchanger comprising distinct lines for heat storage fluid and for working fluid. Heat energy is transferred from the heat storage fluid to the working fluid through a heat bridge, for example a metal connection between the separate lines.

The heat storage fluid and the working fluid may each be a generally arbitrary liquid or gas. The heat storage fluid may in particular be an oil, in particular a thermal oil. The oil may comprise salts and may thus melt at about 200° C. and may be useable from this temperature to about 600° C. Saline thermal oils are thus particularly suitable for receiving heat energy from the heat storage units. The heat storage fluid may be a liquid which is in its liquid phase both before and after running through the heat exchanger. The working fluid may be different from the heat storage fluid and may in particular be water or an aqueous solution. The working fluid may be vaporized when running through the fluid circuit heat exchanger(s). In particular, the boiling temperature of the working fluid at the pressure caused by the working fluid pump may be lower than 200° C. so that it is ensured that the working fluid is always vaporized in the fluid circuit heat exchanger, independent of whether the heat storage fluid has momentarily a high temperature (ca. 600° C.) or a low temperature (ca. 250° C.).

Multistage turbine systems may be used. For example, a second turbine and a second fluid circuit heat exchanger may be provided. The second turbine may thus connect to and drive the generator or a second generator. In the working fluid circuit, the first turbine may be arranged downstream of the first fluid circuit heat exchanger. The second fluid circuit heat exchanger may be arranged downstream of the first turbine. The second turbine may be arranged downstream of the second fluid circuit heat exchanger. In these variants working fluid is thus first heated in the first fluid circuit heat exchanger (and in particular vaporized) and passes then the first turbine. The working fluid then passes through the second fluid circuit heat exchanger to be reheated and then drives the second turbine.

The first and second fluid circuit heat exchangers may be formed separated from each other and in particular similarly. Alternatively, the first and second fluid circuit heat exchangers may be formed by one unit which comprises separate lines for the heat storage fluid, for the working fluid before passing the first turbine and for the working fluid after passing the first turbine, respectively.

The first and the second fluid circuit heat exchangers may be arranged in the heat storage fluid circuit in two lines that are parallel to each other. The heat storage fluid circuit thus comprises a fork into two lines, wherein the heat storage fluid passes through both of those lines. The first fluid circuit heat exchanger is arranged in one of these lines, and the second fluid circuit heat exchanger is arranged in the other of these lines. The two lines merge downstream of the two fluid circuit heat exchangers. The "parallel" arrangement shall thus not be construed as geometrically parallel but as the opposite to a serial arrangement one after the other in which the flow runs through the two fluid circuit heat exchangers consecutively. Advantageously, a sufficiently large heat transfer can thus be ensured in both heat exchangers.

A control device may be provided in the heat storage fluid circuit and may be configured to variably set how heat storage fluid is distributed to the first fluid circuit heat exchanger and the second fluid circuit heat exchanger. This allows to adjust a heat transfer from the heat storage fluid to the working fluid for both fluid circuit heat exchangers differently from each other. For example, after passing the first turbine, the working fluid may have cooled but may be still warmer than before having passed through the first fluid circuit heat exchanger. In this case, the working fluid should receive less heat energy in the second fluid circuit heat exchanger than in the first fluid circuit heat exchanger. To this end, the control device may, for example, divert more heat storage fluid to the first fluid circuit heat exchanger than to the second fluid circuit heat exchanger.

In the working fluid circuit, a first bypass along the first fluid circuit heat exchanger may be provided to guide working fluid to the first turbine, bypassing the first fluid circuit heat exchanger. A bypass may thus designate a bypass pipe. A first bypass control device may be provided and configured to variably set how working fluid is split towards the first fluid circuit heat exchanger and the first bypass. This varies a heat transfer to the working fluid in the first fluid circuit heat exchanger. In particular, this allows to compensate temperature variations of the heat storage fluid partially or completely so that a heat transfer to the working fluid is only affected little by a temperature variation of the heat storage fluid.

The first bypass and the control device may thus form a first quench cooler. The first quench cooler is a mixer which cools a fluid by mixing it with a cooler fluid. In the present case, the cooler fluid is the share of the working fluid which has bypassed the first fluid circuit heat exchanger.

Analogously, a second bypass with respect to the second fluid circuit heat exchanger may be provided. That is, a second bypass along the second fluid circuit heat exchanger may be provided in the working fluid circuit to guide working fluid to the second turbine, bypassing the second fluid circuit heat exchanger. A second bypass control device may be provided and configured to variably set to which parts working fluid is guided to the second fluid circuit heat exchanger and to the second bypass. Again, this allows to operate the two fluid circuit heat exchangers differently and to set a desired temperature of the working fluid after passing the respective fluid circuit heat exchanger.

In principle it is also possible, alternatively or in addition to the above-described bypasses, to provide one or two corresponding bypasses for heat storage fluid in the heat storage fluid circuit. With such a bypass, a variable part of the heat storage fluid is guided through the associated fluid circuit heat exchanger to vary a heat transfer to the working fluid.

In operation of the power plant, it may be preferable if the heat storage fluid is always liquid and not vaporized. In case of vaporization, the heat storage fluid would abruptly remove large amounts of energy from the heat storage as soon as the heat storage fluid reaches the edge or beginning of the heat storage. As a disadvantage, this would discharge the heat storage spatially unevenly. Furthermore, the abrupt vaporization would lead to material wear. These problems are avoided if the heat storage fluid is not vaporized. By contrast, the working fluid should, however, be gaseous or vaporized for driving the turbine(s). This is made possible with the two separate fluid circuits and different fluids: The working fluid may have a lower boiling point/boiling temperature than the heat storage fluid so that the working fluid in the first fluid circuit heat exchanger vaporizes. The working fluid enters an optionally provided second fluid circuit heat exchanger generally as vapor and is then further heated/superheated.

An electrical energy intake by the electrical heater makes sense at low electricity costs, i.e., when there is an oversupply of electrical energy in a power grid which is here referred to as an external power grid. The turbine and the generator may, in contrast, be operated in a timely rather stable manner, thus showing no strong variations over time. An electrical control unit may be provided and configured to variably set whether momentarily more electrical energy is taken from an external power grid by the electrical heater(s) or more electrical energy is output to the external power grid through the generator.

Preferred variants of the method of the invention result from the intended use of the power plant of the invention. Furthermore, the described variants of the method are also to be seen as variants of the power plant of the invention.

BRIEF DESCRIPTION OF THE FIGURES

Further characteristics and advantages of the invention are described in the following with reference to the attached schematic figures.

Similar and similarly acting components are generally indicated in the Figures with the same reference signs.

DETAILED DESCRIPTION OF EMBODIMENTS

Figure 3:
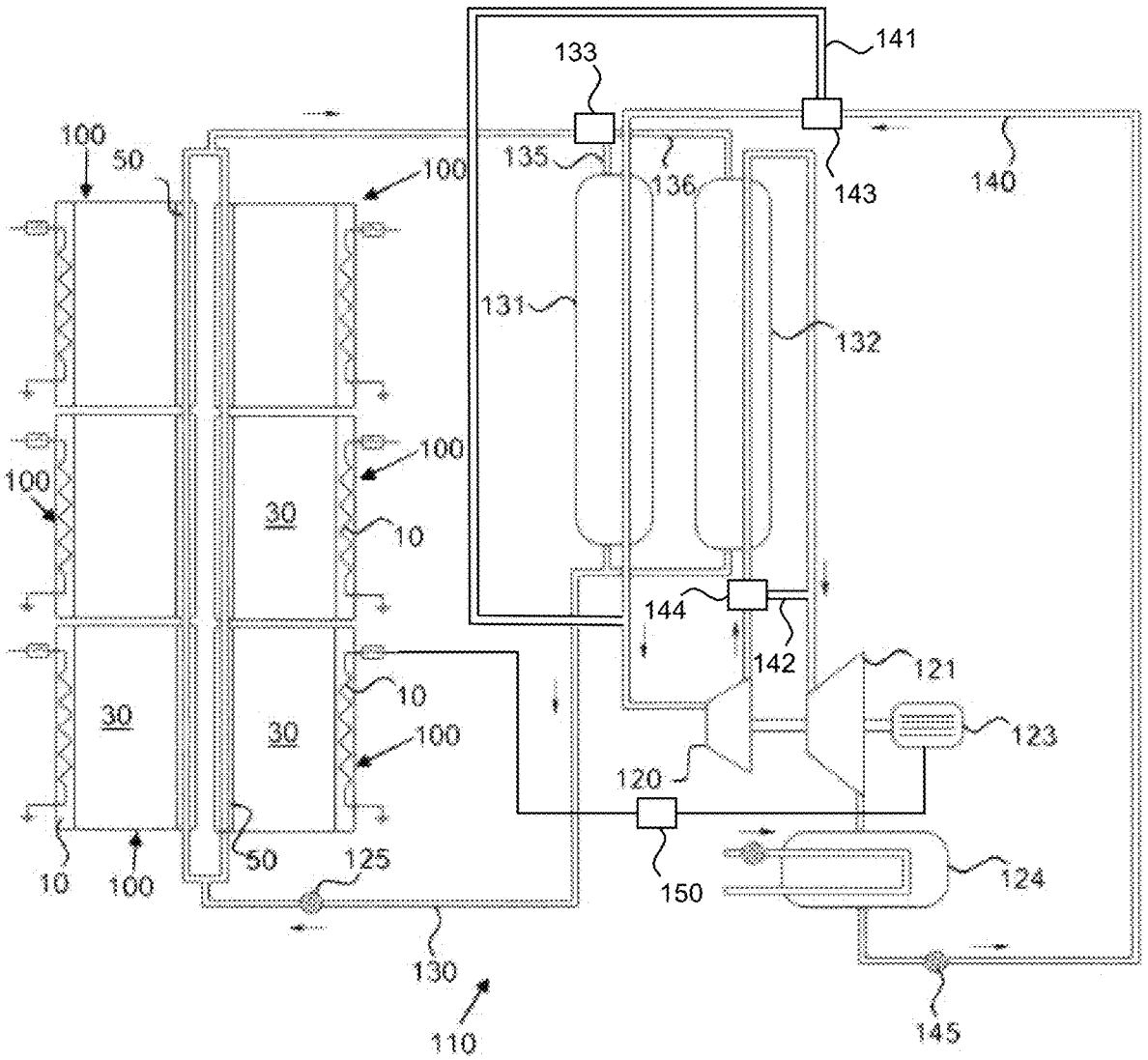
FIG. 3 shows an exemplary embodiment of a power plant of the invention, comprising the heat storage device of the FIGS. 1 and 2.

An exemplary embodiment of a power plant 110 of the invention is schematically shown in FIG. 3.

The power plant 110 comprises a first turbine 120 and may comprise a second turbine 121 or also further turbines (not depicted). The turbines 120, 121 are driven by a working fluid passing through the turbines. The working fluid may be a vapor, for example water vapor. A generator 123 is coupled with the turbines 120, 121 and converts the rotational energy which is provided by the turbines 120, 121 into electrical energy. The electrical energy is then output to an external power grid.

The power plant 110 is used to reduce variations in the amount of electrical energy in the external power grid. To this end, the power plant 110 shall take electrical energy from the external power grid in particular if there is an oversupply. In case of an oversupply, electricity costs may temporarily be very low or even negative, rendering the intake of electrical energy almost cost-free or in some cases even lucrative as such. The received electrical energy shall be stored in the power plant 110 and output again as electrical energy at another time. An electrical control unit 150 is configured to variably set whether momentarily more electrical energy is taken from the external power grid by the electrical heater(s) 10 (only a single control connection is illustrated for clarity) or more electrical energy is output to the external power grid through the generator 123.

Figure 1:
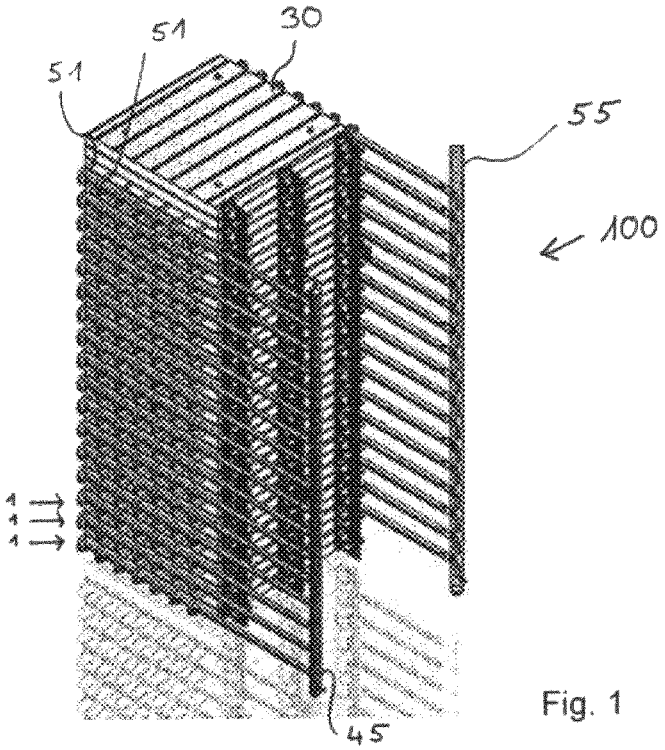
FIG. 1 shows a heat storage device of a power plant of the invention in a perspective view.
Figure 2:
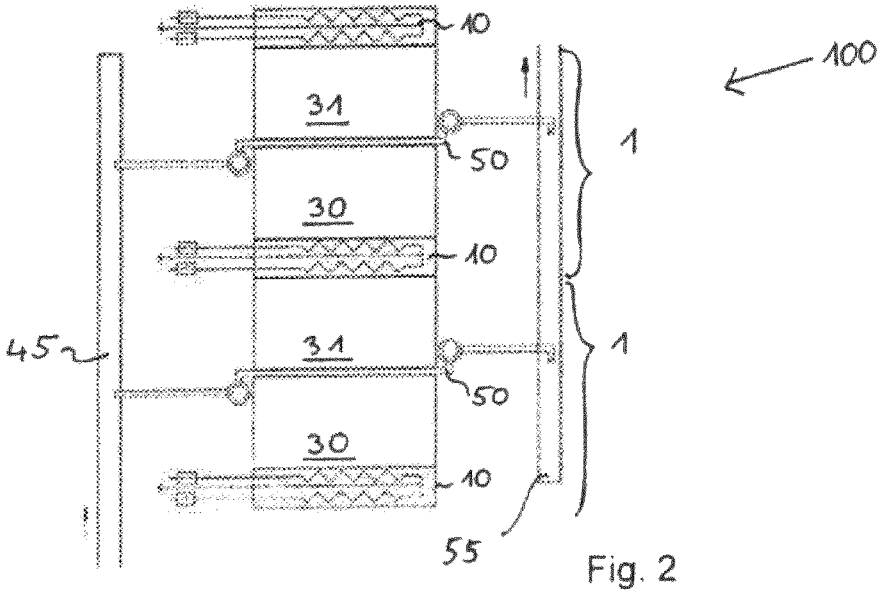
FIG. 2 shows the heat storage device of FIG. 1 in a sectional view.

For this temporary energy storage, the power plant 110 comprises at least one heat storage device 100. In the example of FIG. 3, several heat storage devices 100 are provided. A heat storage device 100 is shown in more detail in the perspective view of FIG. 1 and in the sectional view of FIG. 2. Each heat storage device 100 comprises at least one, preferably several, heat storage units 1 which are stacked on top of each other. Each heat storage unit 1 comprises an electrical heater 10. The electrical heater 10 converts electrical energy into heat energy, preferably substantially completely, i.e., more than 90% of the energy consumed by the electrical heater 10 is converted into heat energy. The electrical energy is received from the external power grid. Each heat storage unit 1 furthermore comprises at least one, in particular exactly two, heat storage bodies 30, 31. These may be metal bodies or metal plates which serve for storing heat energy. The heat storage bodies 30, 31 are arranged next to the electrical heater 10 to receive heat energy from the electrical heater 10. Each heat storage unit finally also comprises a heat exchanger 50 comprising several heat exchanger pipes/tubes 51. Each heat exchanger 50 neighbors at least one of the heat storage bodies 30. In this way, heat energy is transferred from the heat storage body 30 to the heat exchanger pipes and a heat storage fluid transported therein. Through a distributor pipe 45, the heat storage fluid is distributed to the different heat exchangers 50. After passing through the heat exchanger 50, the parts of the heat storage fluid are joined in a collector pipe 55.

The heat energy of the heat storage fluid may now be used to generate electrical energy. As an essential idea of the invention, the heat storage fluid is, however, not led through the turbines 120, 121. Rather, the heat from the heat storage fluid is transferred to another working fluid which is transported in a separate circuit, i.e., the working fluid circuit 140. The heat storage fluid circulates in its own circuit, i.e., the heat storage fluid circuit 130.

This overcomes several disadvantages which would occur if only one circuit were used: Water vapor is often used for driving the turbines; if water were used as the heat storage fluid, it would be vaporized by the heat storage units. With such a phase transition, particularly large amounts of heat energy are taken from the heat storage unit at the edge of the heat storage unit (i.e., its entrance region at which heat storage fluid reaches the heat storage unit). In this way, the heat storage would be unevenly discharged and material wear would be significant. Furthermore the pressure of the fluids at the turbine must be relatively high. With a single circuit this would have the consequence that all lines to the heat storage units must also be designed for higher pressures. The temperature of the heat storage fluid also depends on the momentary temperature of the heat storage units and thus varies. Turbines have, in contrast, a maximal efficiency only for specific temperature/pressure characteristics of the impinging fluids.

These disadvantages are completely or at least partially overcome by using two distinct circuits, i.e., the working fluid circuit 140 and the heat storage fluid circuit 130.

A heat storage fluid pump 125 is arranged in the heat storage fluid circuit 130 to circulate the heat storage fluid in the circuit 130. Furthermore, a working fluid pump 145 is arranged in the working fluid circuit 140 to circulate the working fluid in the circuit 140. The working fluid pump 145 provides a significantly higher pressure than the heat storage fluid pump 125; the pressure may be, for example, at least 10 times as large.

The heat storage fluid may have a higher boiling point than the working fluid so that the heat storage fluid is liquid and not vaporized with heat from the heat storage units. By contrast, the working fluid is vaporized by heat energy from the heat storage fluid and, after passing the turbines 120, 121, it is liquified in a condenser 124. The condenser 124 may comprise, as shown, a heat exchanger through which heat from the working fluid is removed, for example to a liquid which may then be further used, for example for heating purposes. By not vaporizing the heat storage fluid, the above-described disadvantage is avoided that a vaporization abruptly takes large amounts of energy from a part of the heat storage body 30. The heat storage fluid may, for example, be an oil whereas the working fluid may be water or an aqueous solution.

For transferring heat energy from the heat storage fluid to the working fluid, at least a first fluid circuit heat exchanger 131 is provided. In the depicted example, also a second fluid circuit heat exchanger 132 is provided. Through each of these heat exchangers 131, 132, working fluid and separately thereto also heat storage fluid is guided, wherein the respective pipes are thermally coupled to each other for a high heat transfer. A control device 133 is provided in the heat storage fluid circuit 130, which is configured to variably set how heat storage fluid is distributed to the first fluid circuit heat exchanger 131 and the second fluid circuit heat exchanger 132.

The first fluid circuit heat exchanger 131 is arranged upstream of the turbine 120 with regard to the working fluid circuit 140. The second fluid circuit heat exchanger 132 is, by contrast, arranged between the two turbines 120, 121 with regard to the working fluid circuit 140. The working fluid circuit 140 includes a first bypass 141 along the first fluid circuit heat exchanger 131 to guide working fluid to the first turbine 120, bypassing the first fluid circuit heat exchanger 131. A first bypass control device 143 is configured to variably set how working fluid is split towards the first fluid circuit heat exchanger 131 and the first bypass 141. The working fluid circuit 140 includes a second bypass 142 along the second fluid circuit heat exchanger 132 to guide working fluid to the second turbine 121, bypassing the second fluid circuit heat exchanger 132. A second bypass control device 144 is configured to variably set to which parts working fluid is guided to the second fluid circuit heat exchanger 132 and to the second bypass 142.

The two fluid circuit heat exchangers 131, 132 may be arranged parallel to each other with regard to the heat storage fluid circuit 130. A line of the heat storage fluid may fork into two lines 135, 136 before the two fluid circuit heat exchangers 131, 132, wherein the two lines 135, 136 lead through one of the two fluid circuit heat exchangers 131, 132, respectively. Thereafter the two lines 135, 136 merge.

As depicted, at least some of the heat storage devices 100 may be arranged in lines that are parallel to each other. This has the advantage that the heat storage devices 100 arranged parallel to each other are basically similarly discharged, i.e., in particular basically similar amounts of energy are transferred to the passing heat storage fluid. This avoids that a heat storage device 100 reaches a maximal temperature and is thus not able to receive and store further energy from the external power grid, while others of the heat storage devices 100 are further below their maximal temperature. If many of the heat storage devices 100 are able to receive electrical energy simultaneously, a maximal possible intake of electrical energy is advantageously larger.

Furthermore, some of the heat storage devices 100 may be arranged in the heat storage fluid circuit 130 one after the other so that heat storage fluid passes through them consecutively. Here, the discharge (i.e., the heat transfer to the heat storage medium) varies for the consecutively arranged heat storage devices 100. However, this arrangement also has advantages: The heat storage fluid should not fall below a minimal temperature (low temperature threshold), resulting in a minimal temperature for a heat storage device 100. However, it is desirable that a minimal temperature of the heat storage device 100 is low as this increases a possible temperature difference of the heat storage device 100 and thus increases its storage capacity. If two or more heat storage devices 100 are arranged behind each other, they can be operated with different minimal temperatures. An anterior (front) heat storage device of these heat storage devices 100 may have a lower minimal temperature than a posterior (back) heat storage device of these heat storage devices 100. The posterior heat storage device 100 ensures a desired minimal temperature/low temperature threshold of the heat storage fluid. The anterior heat storage device 100, by contrast, may be operated over a very large temperature range (i.e., over a larger temperature range than the posterior heat storage device 100) and thus has a particularly high storage capacity. Alternatively or in addition, also the respective maximal temperatures of the consecutively arranged heat storage devices 100 may be different.

In other words, a control device may be provided and configured to operate an anterior heat storage device 100 of the consecutively arranged heat storage devices 100 over a larger temperature range than a posterior heat storage device 100.

In addition to the temperature range of the heat storage body 30, i.e., the range between the minimal and maximal temperatures used in operation, also the total mass of their heat storage bodies 30 is relevant for the total storage capacity of a heat storage device 100. If a posterior heat storage device 100 of several consecutively arranged heat storage devices is in any case only operated over a smaller temperature range, it is expedient if the mass of its heat storage bodies is chosen smaller than the mass of the heat storage bodies of the anterior heat storage device 100. This may be realized, for example, in that the anterior heat storage device comprises more heat storage units than the posterior heat storage device; apart from that, the heat storage units of the anterior and the posterior heat storage devices 100 may be similar.

In addition to the depicted components, the power plant 110 may also comprise a burner for a (fossil) energy carrier, for example for burning coal, natural gas or syngas. The heat thus released may also be transferred to the working fluid or the heat storage fluid. Provision may be made to control a power of the burner dependent of an electrical power consumption/intake by the electrical heater 10. Electrical power is consumed in particular (or exclusively) if there is an oversupply of electrical energy. During such periods it is thus desirable if less electrical energy is generated and the power of the burner is accordingly reduced. The power of the burner can thus be decreased to a reduced value when the heat storage devices 100 are charged, in particular when their electrical power intake surpasses a predefined threshold. By contrast, the power of the burner is not decreased to the reduced value but is maintained at a higher value if the power intake by the electrical heater does not surpass the threshold.

With the power plant of the invention, large amounts of electrical energy may be stored as heat energy and then converted back into electrical energy in an easy and cost-efficient way.

The invention claimed is:

1. A power plant for generating electrical energy, comprising:

at least one heat storage device for storing electrical energy as heat energy, including at least one heat storage unit, wherein each of the at least one heat storage unit comprises:

an electrical heater for converting electrical energy into heat energy;

at least one heat storage body for receiving and storing heat energy from the electrical heater;

a heat exchanger for receiving heat energy from the at least one heat storage body, wherein the heat exchanger comprises heat exchanger tubes for guiding a heat storage fluid;

a first turbine;

a generator coupled with the first turbine for generating electrical energy from a rotational movement provided by the first turbine;

a heat storage fluid circuit which is connected with the heat exchanger tubes of the heat exchanger of the at least one heat storage device;

a working fluid circuit which is connected with the first turbine;

a first fluid circuit heat exchanger for transferring heat from the heat storage fluid to a working fluid in the working fluid circuit;

a second turbine and a second fluid circuit heat exchanger;

the second turbine is coupled with the generator to drive the generator;

the first turbine is arranged downstream of the first fluid circuit heat exchanger in the working fluid circuit;

the second fluid circuit heat exchanger is arranged downstream of the first turbine;

the second turbine is arranged downstream of the second fluid circuit heat exchanger;

the first and the second fluid circuit heat exchangers are arranged in the heat storage fluid circuit in two lines which are parallel to each other;

further comprising a control device in the heat storage fluid circuit which is configured to variably set distribution of the heat storage fluid to the first fluid circuit heat exchanger and/or the second fluid circuit heat exchanger.

2. The power plant of claim 1, further comprising a first bypass along the first fluid circuit heat exchanger in the working fluid circuit to guide working fluid to the first turbine, bypassing the first fluid circuit heat exchanger, and a first bypass control device configured to variably set distribution of the working fluid to the first fluid circuit heat exchanger and/or to the first bypass.

3. The power plant of claim 1, further comprising a second bypass along the second fluid circuit heat exchanger in the working fluid circuit to guide working fluid to the second turbine, bypassing the second fluid circuit heat exchanger, and a second bypass control device configured to variably set distribution of the working fluid to the second fluid circuit heat exchanger and/or to the second bypass.

4. The power plant of claim 1, further comprising an electrical control unit configured to variably set whether momentarily more electrical energy is taken from an external power grid through the electrical heater of the at least one heat storage device or whether more electrical energy is output to the external power grid by the generator.

5. The power plant of claim 1, the at least one heat storage device comprising a plurality of heat storage devices of which at least some are arranged parallel to each other such that the corresponding heat exchanger tubes are parallel to each other in the heat storage fluid circuit.

6. The power plant of claim 1, the at least one heat storage device comprising a plurality of heat storage devices of which at least some are serially arranged such that the corresponding heat exchanger tubes are serially arranged in the heat storage fluid circuit.

7. The power plant of claim 6, the serially arranged heat storage devices including an anterior heat storage device and a posterior heat storage device, the power plant further comprising a control device configured to operate the anterior heat storage device over a larger temperature range than the posterior heat storage device.

8. The power plant of claim 6, wherein an anterior heat storage device of the serially arranged heat storage devices comprises more heat storage units than a posterior heat storage device of the serially arranged heat storage devices.

9. A method for operating a power plant to generate electrical energy, the method comprising the following steps:

converting electrical energy into heat energy with an electrical heater of a heat storage unit of at least one heat storage device;

receiving and storing heat energy of the electrical heater with at least one heat storage body of the heat storage unit;

transferring heat energy of the at least one heat storage body to a heat storage fluid by a heat exchanger which comprises heat exchanger tubes for guiding the heat storage fluid;

guiding the heat storage fluid along a heat storage fluid circuit which comprises a first fluid circuit heat exchanger and a second fluid circuit heat exchanger which are parallel to each other;

transferring heat energy from the heat storage fluid to a working fluid, by the first fluid circuit heat exchanger and/or the second fluid circuit heat exchanger;

guiding the working fluid in a working fluid circuit to a first turbine for driving the first turbine and to a second turbine for driving the second turbine, wherein the first turbine is located downstream from the first fluid circuit heat exchanger in the working fluid circuit, the second turbine is located downstream from the second fluid circuit heat exchanger in the working fluid circuit, and the second fluid heat exchanger is located downstream of the first turbine;

generating electrical energy from a rotational movement provided by the first turbine and the second turbine by a generator coupled with the first turbine and the second turbine, wherein the second turbine drives the generator.

10. The method of claim 9, further comprising at least the following steps:

operating a working fluid pump to pressurize the working fluid in the working fluid circuit;

operating a heat storage fluid pump to pressurize the heat storage fluid in the heat storage fluid circuit;

operating the working fluid pump and the heat storage fluid pump such that the pressure of the working fluid is higher than the pressure of the heat storage fluid.

11. The method of claim 9, further comprising at least the following steps:

guiding the heat storage fluid in liquid form to and through the at least one heat storage device, wherein the heat storage fluid is not vaporized;

guiding the working fluid through the first fluid circuit heat exchanger and/or the second fluid circuit heat exchanger, wherein the working fluid is vaporized.

* * * * *